United States Patent [19]

Chang

[11] Patent Number: 4,917,072

[45] Date of Patent: Apr. 17, 1990

[54] ARROW SIGHTING AND SUPPORT APPARATUS

[75] Inventor: Steven Chang, Bardonia, N.Y.

[73] Assignee: C & M Sports Enterprises, Inc., W. Nyack, N.Y.

[21] Appl. No.: 296,100

[22] Filed: Jan. 12, 1989

Related U.S. Application Data

[63] Continuation-in-part of Ser. No. 217,191, Jul. 11, 1988, Pat. No. 4,858,589.

[51] Int. Cl.[4] ..... F41B 5/00

[52] U.S. Cl. ..... 124/41 A; 124/24 R; 124/87

[58] Field of Search ..... 124/41 A, 24 R, 86, 124/87, 88, 26; 33/265

[56] References Cited

U.S. PATENT DOCUMENTS

| | | | |
|---|---|---|---|
| 3,760,788 | 9/1973 | Hartman | 124/24 R X |
| 4,027,645 | 6/1977 | Damron | 124/24 R |
| 4,282,850 | 8/1981 | Warnicke | 124/41 A X |
| 4,290,407 | 9/1981 | Damron | 124/88 X |
| 4,351,311 | 9/1982 | Phares | 124/41 A |
| 4,372,282 | 2/1983 | Sanders | 124/41 A X |
| 4,569,325 | 2/1986 | Christian | 124/41 A |

*Primary Examiner*—Peter M. Cuomo
*Attorney, Agent, or Firm*—Stanley J. Yavner

[57] ABSTRACT

A combination arrow sight and support device for use with an arrow having feathers and an archery bow comprises a generally conical frame having a ring portion and a conical portion. The conical portion defines a central arrow support aperture and includes arrow feather slots to permit passage of the feathers therethrough. An entrance slot permits entrance of the arrow into said central aperture. The arrow slots may be either straight or curved to provide an axial rotation to the arrow as it passes through the unit.

3 Claims, 4 Drawing Sheets

FIG. 1
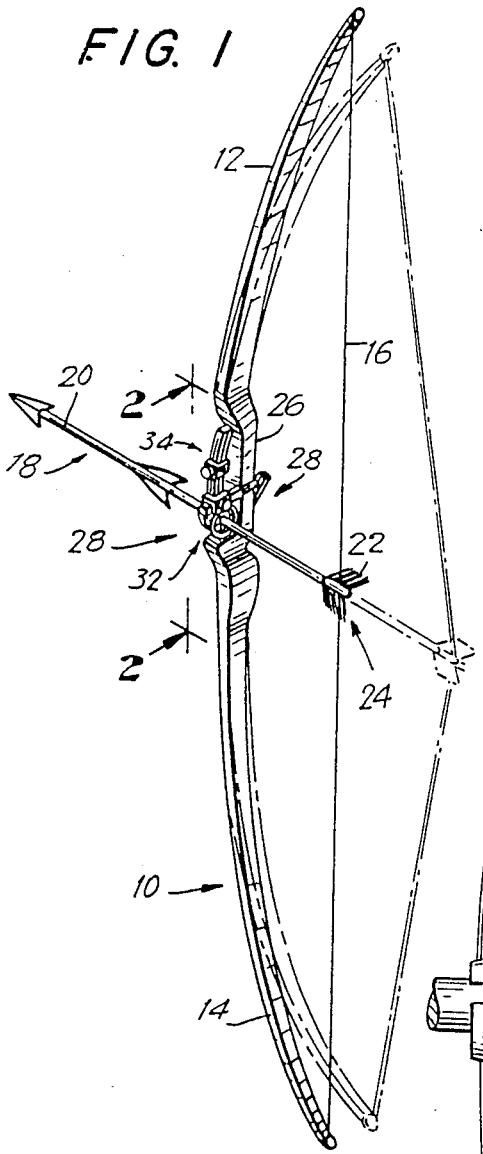
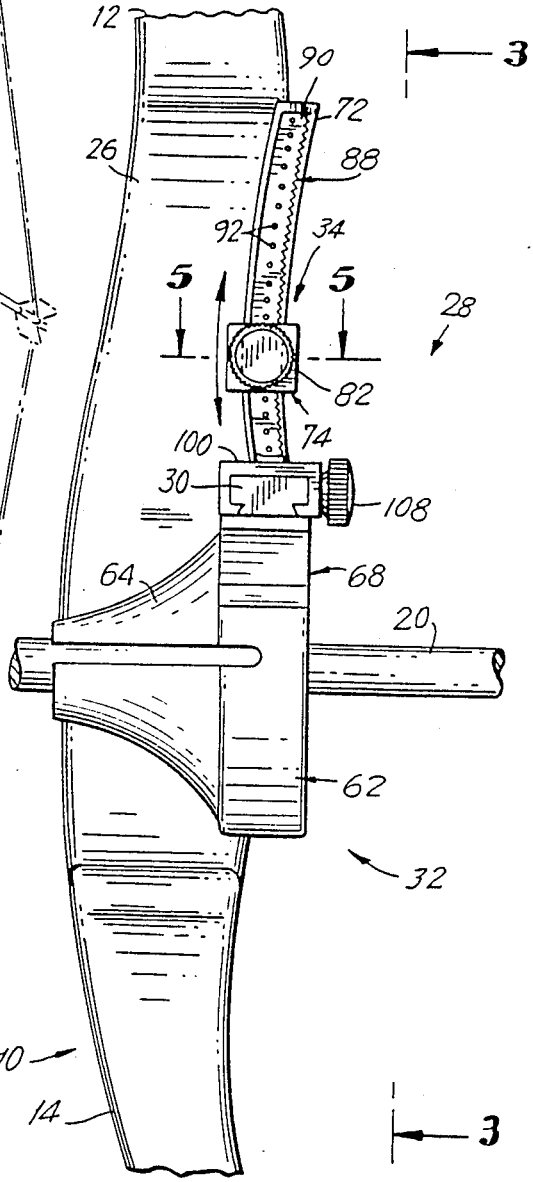
FIG. 2

FIG. 5
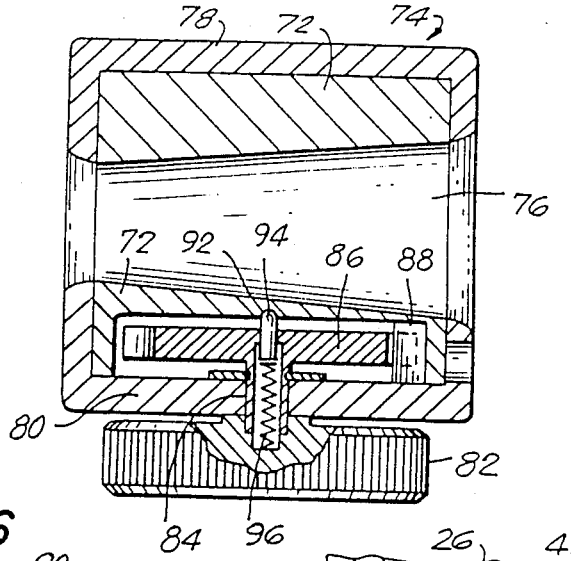
FIG. 6
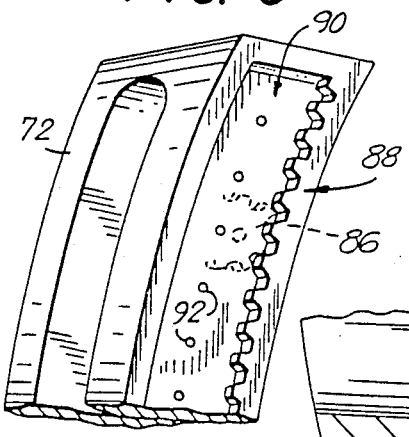
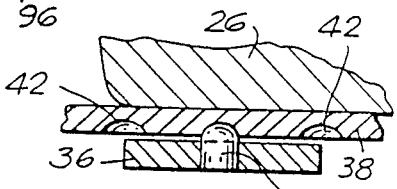
FIG. 8
FIG. 7
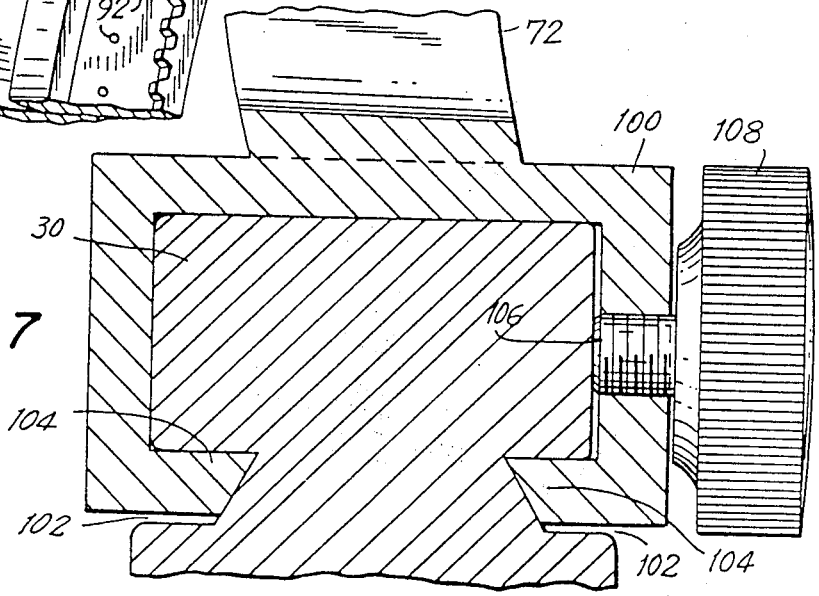

ARROW SIGHTING AND SUPPORT APPARATUS

This application is a continuation-in-part of application Ser. No. 217,191 filed July 11, 1989, now U.S. Pat. No. 4,858,589.

BACKGROUND OF THE INVENTION

The present invention relates to an arrow sighting and support, apparatus, and, in particular, to a new and improved apparatus for use in conjunction with an archery bow, whereby an arrow may be supported and accurately sighted upon a distant target, so that it may be launched properly and accurately toward the target.

Proficient use of a bow and arrow require the archer to properly support the arrow as the bow is drawn and released, and to properly align the bow and arrow with respect to the intended target such that, when released, the arrow is directed to the target. The purpose of the present invention is thus to provide a combination sight and arrow support in which both functions are embodied in a unitary apparatus, such apparatus being easily installed upon a conventional bow and which may be easily and efficiently operated by the archer.

The present invention consist of the combination of a sight, which may be of the peep-sight form, and an arrow stabilizer mechanism, both mounted to a horizontal bar. The horizontal bar is adjustably mounted to the bow by means of a mounting plate and intermediate support arm. The support arm allows the horizontal bar to be adjustable in the vertical direction. In addition, the peep-sight is horizontally positionable upon the horizontal bar. The combination of these adjustments allow accurate sighting and arrow support to be achieved. Furthermore, depending from the horizontal bar, either directly or indirectly, is a rigid or flexible conical frame, defining a central aperture for supporting the arrow shaft. The sides of the cone define slots for receiving feathers, and in an alternative embodiment of the present invention, guiding such feathers with a rotational rifling motion.

Within the inventor's knowledge at this time are the following patents, which have been cited against the parent application hereof:

| U.S. Pat. No | Inventor |
|---|---|
| 4,584,777 | Saunders |
| 4,398,528 | Troncoso Jr. |
| 4,236,497 | Troncoso Jr. |
| 3,450,122 | Diamona |
| 2,909,167 | Fredrickson |
| 2,642,661 | Fredrickson |
| 1,847,593 | Cameron |

The foregoing represents art which is even less applicable to the present invention, than it was to the parent hereof. This invention is deemed patentable thereover.

A BRIEF DESCRIPTION OF THE DRAWINGS

A fuller understanding of the present invention will be obtained upon consideration of the following detailed description of a preferred, but nonetheless illustrative embodiment of the invention when taken in conjunction with the annexed figures, wherein FIG. 1 is a perspective view of a conventional archery bow utilizing the present invention;

FIG. 2 is a side elevational view of the present invention as taken along line 2—2 of FIG. 1;

FIG. 5 is a top sectional plan view of the sight portion of the present invention taken along line 5—5 of FIG. 2, detailing the vertical adjustment means therefor;

FIG. 6 is a detailed perspective view of the upper portion of the sight, illustrating the adjustment gear track utilized in the invention;

FIG. 7 is a sectional elevational view of the sight mounting means as taken along line 7—7 of FIG. 3;

FIG. 8 is a sectional detailed view taken along line 8—8 of FIG. 4 illustrating the means by which the vertical positioning of the horizontal bar of the apparatus is achieved;

DETAILED DESCRIPTION OF A PREFERRED EMBODIMENT OF THE INVENTION

Figure 3:
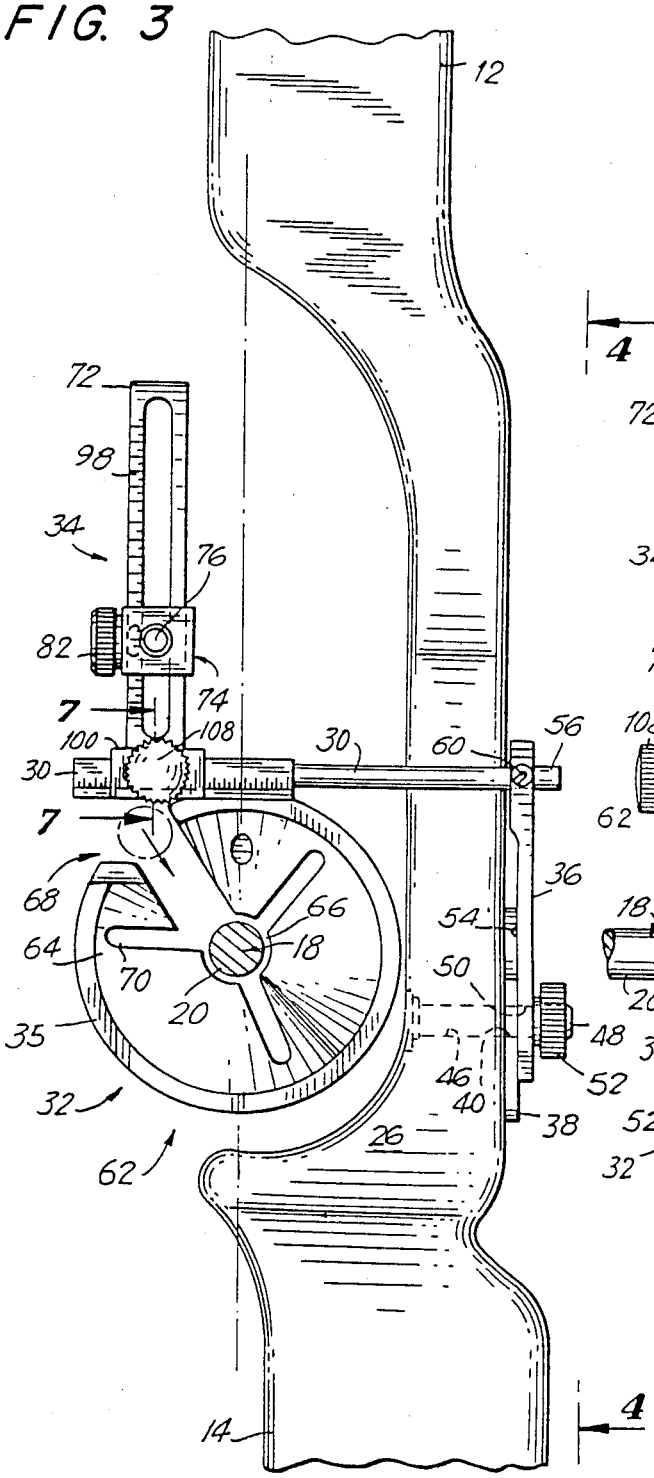
FIG. 3 is a rear elevational view of the invention as taken along line 3—3 of FIG. 2.

Referring initially to FIG. 1, bow 10 has opposed arms 12, 14 joined by central hand-grip portion 26. A bow-string 16 is in tension and supported by the tips of the arms. An arrow 18, having a shaft 20 bearing vanes or feathers 22 at the nocked end 24 thereof is supported adjacent hand-grip portion 26 by combination sight and arrow support apparatus 28 which permits the arrow to be sighted upon a target and supported during drawstring tensioning and release.

As best seen in FIGS. 2 and 3, apparatus 28 includes horizontal bar 30 which extends from bow hand-grip section 26 across the extension of the vertical plane defined by the travel of bowstring 16 as it is drawn and released by the archer. Mounted to arm 30 and depending therefrom is arrow support portion 32, which may be permanently affixed to arm 30 in a manner such that it supports the arrow 18 in proper registry with the plane of bowstring 16 to permit accurate flight as hereinafter described.

Also mounted to horizontal bar 30 is peep-sight 34, which is adjustable both horizontally and vertically, as will be explained hereinafter, to adjust for target distance and windage as required. Horizontal bar 30 is affixed to bow 26 by means of an intermediate bar support arm 36, which is pivotally connected both to horizontal bar 30 and to mounting plate 38, which is itself affixed to bow hand-grip 26.

Figure 4:
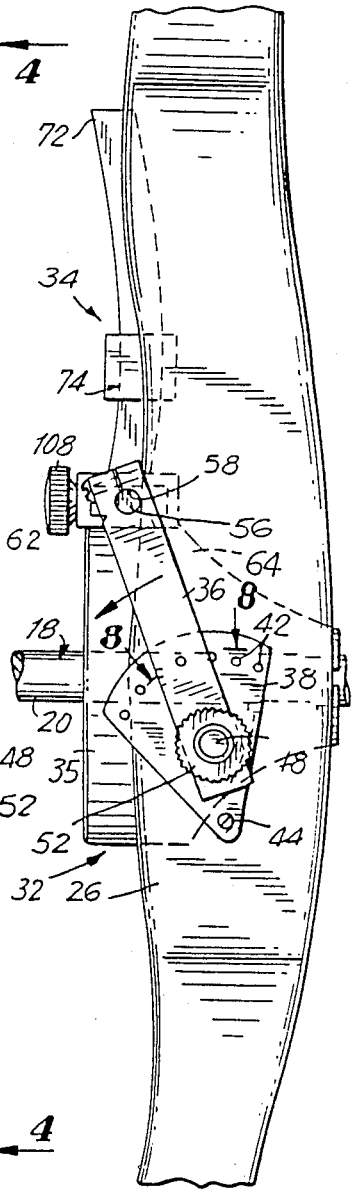
FIG. 4 is a side elevational view as taken along line 4—4 of FIG. 3.

As may be seen in FIG. 4, mounting plate 38 may be in the form of a generally triangular piece having a central bore 40, as well as a plurality of generally hemispheric indentations 42 on its outwardly-directed face arranged in an arc about the axis of bore 40. Mounting plate 38 may be affixed to bow hand-grip portion 26 by screw 44, which extends through an appropriately located and sized bore in the mounting plate 38.

Hand-grip portion 26 is provided with a throughbore 46 aligned with bore 40 in mounting plate 38 to allow a threaded bolt 48 to be inserted through the bow such that its threaded end projects outwardly through mounting plate 38. Bar support arm 36 is provided with an appropriately sized bore 50 to permit the bar support arm to pivot about bolt 48 and to be locked in position as appropriate by adjustment nut 52. The inner face of bar support arm 36 is provided with a projection 54, located and dimensioned to engage one of the indentations 42 as the support arm is pivoted, to further lock the bar support arm in position.

The end 56 of horizontal bar 30 is cylindrical in cross-section, and fits within a bore 58 located at the upper end of bar support arm 36. A set screw 60 may be provided proximate the bore 58 to provide tension and/or locking of the pivoting action between the horizontal bar and the bar support arm.

Figure 9:
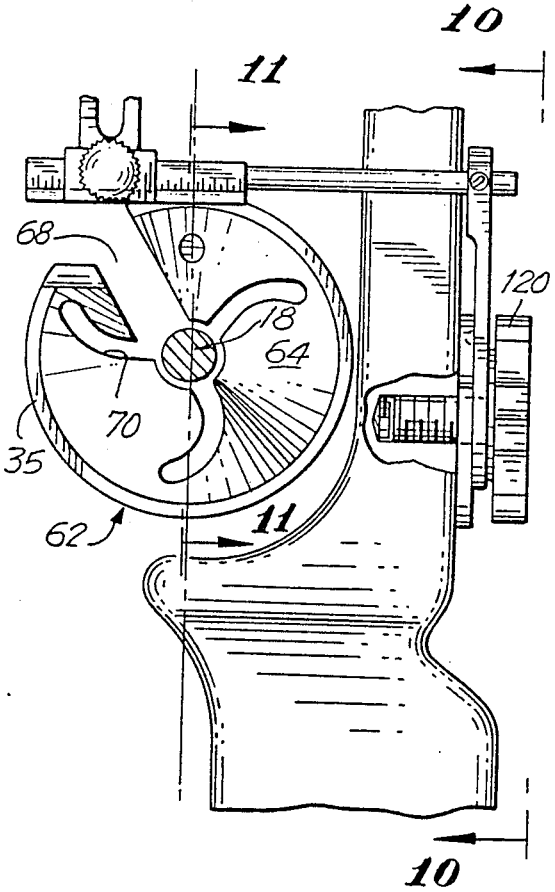
FIG. 9 is a partial rear elevational view, similar to that shown in FIG. 3, but with a rotational, rifling capability presented by means of the conical frame defining curved plots.

Referring to FIGS. 2 and 3, arrow support section 32 is composed of generally conical frame 62 defining a central aperture 66 in which arrow shaft 20 is supported. The conical portion 64 of frame 62 is of the same metallic material as the ring portion 35 thereof, and defines slots 70 (the number of slots may be 3, 6 or another chosen number) to guide and support the arrow 18. Slots 70 may be of an orientation parallel to arrow shaft 20, or as shown in FIG. 9, of a curved orientation to guide arrow 18 and its feathers 22 in a rotational, rifling path in order to provide stability. Conical frame 62 is provided with a peripheral notch 68, such that the arrow shaft 20 can be inserted into central aperture 66 through the side of the arrow support unit. Central aperture 66 of conical frame 62, in addition to encircling arrow 18, also provides initial support therefor. The frame 62 is mounted to a horizontal bar by appropriate means, such as recessed screw 71.

Peep-sight assembly 36 includes vertically slotted range bar 72, upon which sight 74, having central viewing aperture 76, is mounted. As seen in FIG. 2, range bar 72 is vertically curved, the radius of the curve being 28 inches, corresponding to the distance from the sight to the eye of the archer when the bowstring is fully drawn. As may be seen in FIG. 5, sight 74 may be generally U-shaped in horizontal cross-section, such that its opposed legs 78, 80 embrace the opposed sides of vertical range bar 72. Mounted on leg 80 of sight 74 is vertical adjustment knob 82, which is journaled for rotation on hollow shaft 84 extending through the leg 80.

Gear 80 is also mounted to shaft 84 for rotation with knob 82, and engages gear rack 88, as best seen in FIG. 6, formed as an inner edge of pathway 90 located on an exterior side of the range bar 72. Located along the length of the pathway 90, adjacent gear rack 88, are a series of spaced indentations 92, located to be coaxial with the path of travel of hollow shaft 84 within the length of pathway 90. Nub 94 is spring-loaded by spring 96 within hollow shaft 84, and is engageable with the indentations 92 as sight 74 is moved along vertical range bar 72 to provide a "click-stop" adjustment feature. An external edge of vertical range bar 72 may be provided with appropriate indicia 98, as may be seen in FIG. 3, to provide range reference settings for the unit.

As may be best seen in FIGS. 2 and 7, sight unit 36 is mounted for horizontal movement upon horizontal bar 30 by means of a base member 100 slideable along the horizontal bar. Horizontal bar 30 is provided with a pair of opposed longitudinal dovetail slots 102 into which generally opposed, inwardly-directed portions 104 of U-shaped base member 100 project. A threaded shaft 106, mounted in an appropriately threaded bore in base 100 and having adjustment knob 108, is provided to lock base 100 and sight 34 in position along horizontal bar 30 as may be required.

The dual pivoting nature of bar support arm 36 permits horizontal bar 30 to retain arrow support unit 32 and peep-sight 36 in proper vertical orientation as the effective vertical position of horizontal bar 30 with respect to the bow is adjusted. Once that adjustment is made by pivoting the bar support arm as required, sight 34 may be adjusted, both vertically and horizontally, to properly locate the target and aim the arrow. With such adjustments, an arrow may be inserted into the arrow support 32, whereby it is properly maintained and positioned during string tensioning and release.

Figure 10:
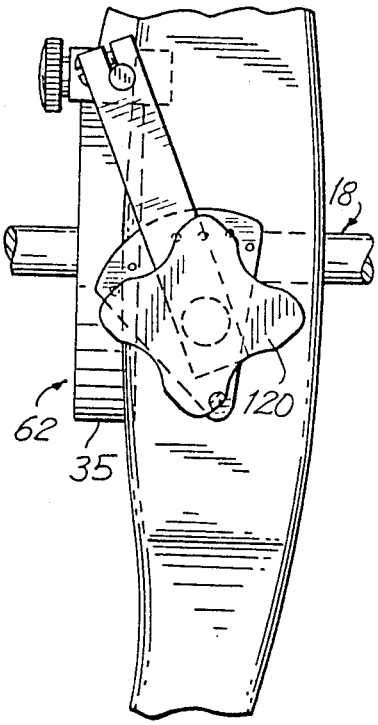
FIG. 10 is a sectional elevational view, showing an alternatively defined bolt for rotationally attaching the intermediate support arm for pivotal motion.
Figure 11:
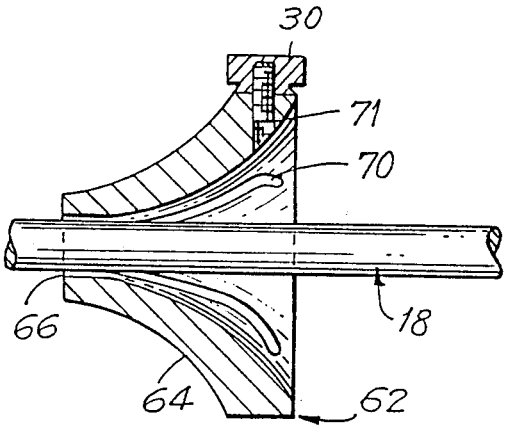
FIG. 11 is a sectional view of the conical frame of FIG. 9, taken along the line 11—11 thereof.

Alternative to the bolt 48, as shown in FIG. 3, headed bolt 120, as shown in FIGS. 9 and 10 may be used, tapping into hand-grip portion 26, instead of use of throughbore 46, as shown in FIG. 3.

The present invention, while allowing for accurate sighting, may be easily removed from and installed on a bow. In addition, the unit may be made of any appropriate material, including plastic or a variety of metals and compositions as known in the art.

What is claimed is:

1. A combination arrow sight and support device for use with an arrow having feathers and an archery bow upon which is adjustably mounted a horizontal bar comprising a generally conical frame mounted to said horizontal bar having a ring portion and a conical portion, said conical portion defining a central and single arrow support aperture and arrow feather slots with a side entrance slot enabling entrance of said arrow to said central aperture for providing guidance and support for said arrow, said arrow sight and support device being operationally connected for mounting on an archery bow with a drawstring and a hand-grip portion, which includes said horizontal bar projecting outwardly from said bow across the plane defined by drawstring action and in front of the undrawn position of the drawstring, peep-sight mounted for adjustable travel along said bar and projecting upwardly therefrom, a mounting plate adapted to be secured to the bow proximate the hand-grip portion thereof, and an intermediate support arm, having first and second ends pivotably mounted to said mounting plate about a horizontal axis at said first end and pivotably mounted to said horizontal bar at said second end.

2. The invention according to claim 1, wherein said peep-sight comprises a vertical range bar and a sight piece positionably along the length of said range bar by means of a gear assembly.

3. The invention according to claim 1, wherein a bolt is tapped into said hand-grip portion through said mounting plate.

* * * * *